United States Patent [19]

Uemura

[11] 4,081,716

[45] Mar. 28, 1978

[54] FLUORESCENT DISPLAY ELEMENTS

[75] Inventor: Sashiro Uemura, Mie, Japan

[73] Assignee: Ise Electronics Corporation, Ise, Japan

[21] Appl. No.: 772,555

[22] Filed: Feb. 28, 1977

[30] Foreign Application Priority Data

Mar. 1, 1976 Japan ..... 51-21927

[51] Int. Cl.[2] ..... H01J 31/12; H01J 63/06; H01J 41/36

[52] U.S. Cl. ..... 313/63; 313/497; 315/73

[58] Field of Search ..... 313/392, 495, 497, 496; 315/73, 63, 58

[56] References Cited

U.S. PATENT DOCUMENTS

| | | | |
|---|---|---|---|
| 3,262,010 | 7/1966 | Kazan | 315/63 |
| 3,956,667 | 5/1976 | Veith | 315/58 X |

*Primary Examiner*—Palmer C. Demeo

*Attorney, Agent, or Firm*—Boone, Schatzel, Hamrick & Knudsen

[57] ABSTRACT

A switching element is mounted on a substrate covered by an envelope, and a fluorescent film is formed on the switching element. A cathode electrode is provided to face the fluorescent film, and a grid electrode is disposed therebetween.

14 Claims, 10 Drawing Figures

(a)

(b)

(a)

(b)

FLUORESCENT DISPLAY ELEMENTS

BACKGROUND OF THE INVENTION

This invention relates to a fluorescent display element utilized to construct a fluorescent display device in which a plurality of the fluorescent display elements are arranged in a matrix for displaying charactors, patterns or images on a plane.

Among prior art plane display devices are included luminous diode type, electroluminescence type, plasma display type and cathode ray tube type display devices. However, each of them is not satisfactory. For example, the luminuous diode type is expensive, the electro luminescence type involves many problems not yet solved, and the plasma type requires a high drive voltage and hence expensive. Although the cathode ray tube type is inexpensive, its reliability against vibration is poor and it is difficult to obtain a flat display panel with the cathode ray tube type. Furthermore, in the prior art display devices not only the brightness is low but also the control thereof is not easy.

In the prior art fluorescent display device, transistors for driving the displayed numerical digits, for example, were installed on the outside of the display device so that the wiring of the device is complicated.

SUMMARY OF THE INVENTION

Accordingly, it is an object of this invention to provide an improved fluorescent display element and a fluorescent display device utilizing the same which can be driven with a low driving voltage, has a high switching speed and reliability, can operate with a low power and readily control the brightness of the display.

Another object of this invention is to provide a novel fluorescent display element not requiring an external driving transistor, can simplify the wiring, can be operated with a low driving voltage and has a compact construction.

According to this invention there is provided a fluorescent display element comprising a substrate, an envelope hermetically sealed to the substrate to form a sealed space therebetween, a switching element formed on the substrate in the sealed space, a fluorescent film formed on the switching element, a cathode electrode provided in the sealed space to face the fluorescent film, and a grid electrode interposed between the cathode electrode and the fluorescent film.

According to another aspect of this invention, there is provided a fluorescent display device comprising a substrate, an envelope hermetically sealed to the substrate to form a sealed space therebetween, a plurality of switching elements arranged on the substrate in the form of a matrix, each switching element including a fluorescent film applied thereon, a first electrode connected to an X-axis lead wire and a second electrode connected to a Y-axis lead wire of the matrix, a plurality of cathode electrodes provided in the sealed space to face the fluorescent films, and a control electrode disposed between the cathode electrodes and the fluorescent films.

BRIEF DESCRIPTION OF THE DRAWINGS

Further objects and advantages will be more fully understood from the following detailed description taken in conjunction with the accompanying drawings in which.

DESCRIPTION OF THE PREFERRED EMBODIMENTS

Figure 1:
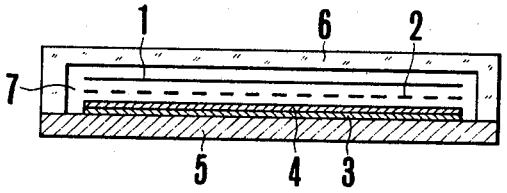
FIG. 1 is a sectional view of one embodiment of the fluorescent display device constructed in accordance with this invention.
Figure 3:
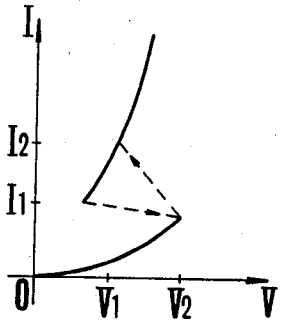
FIG. 3 is a graph showing the V-I characteristic of a switching element utilized in the fluorescent display element shown in FIG. 2.
Figure 8:
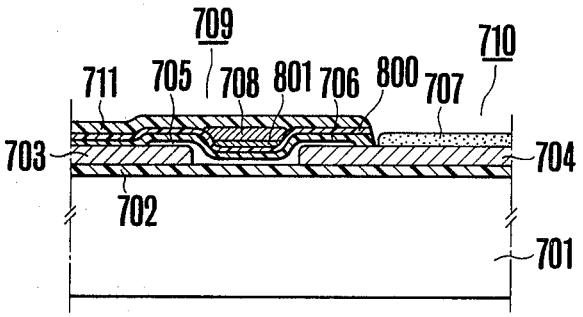
FIG. 8*a* is a sectional view showing still another embodiment of the fluorescent display element of this invention.
FIG. 8*b* is a connection diagram of one example of the fluorescent display device utilizing the fluorescent display elements shown in FIG. 8*a*.
Figure 8:
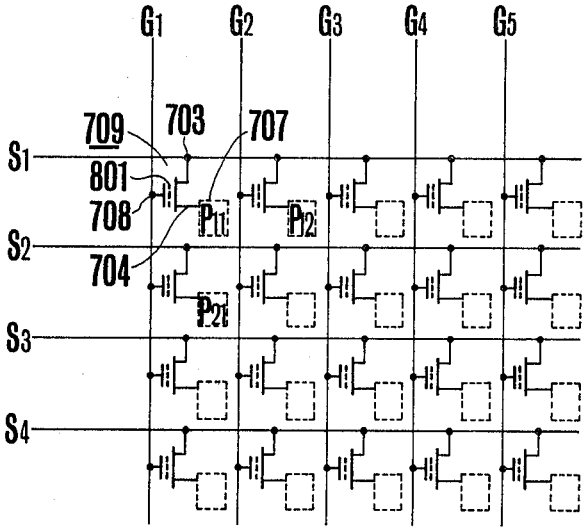

The fluorescent display element shown in FIG. 1 comprises a cathode electrode 1 such as a hot or cold cathode electrode for emitting electrons, a control electrode 2 for controlling or uniformly dispersing the electrons emitted from the cathode electrode 1, an integrated switching element 3 formed of a semiconductor material, a combination of a semiconductor material with an insulator material or a dielectric material, or a combination of metal, a dielectric material and an insulator material and manifesting a V-I characteristic as shown in FIG. 3. A plurality of such switching elements are arranged in a matrix (a FIG. 8 shape, for example) to form a picture element. Further, the fluorescent display element is provided with a fluorescent film 4 coated on the active element 3 that constitutes the picture element, a substrate 5 made of metal, ceramic or a semiconductor, and a transparent face plate 6 made of glass, for example and hermetically sealed to the substrate 5. The space 7 within the envelope is evacuated or filled with inert gas.

The cathode electrode 1 is supported in the space 7 by suitable supporting means to oppose the fluorescent film 4, and the control electrode 2 is disposed between the cathode electrode 1 and the fluorescent film by suitable supporting means not shown.

Figure 2:
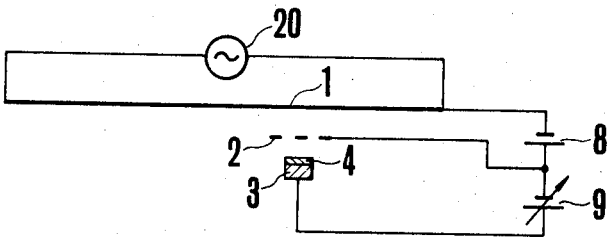
FIG. 2 is a connection diagram utilized to explain the operation of a fluorescent display element incorporated into the fluorescent display device shown in FIG. 1.

FIG. 2 shows the electrical connection between a switching element 3 of a fluorescent display element constituting a picture element and a grid source 8 and a source of variable voltage 9.

The operation of the fluorescent display element described above will be described with reference to FIGS. 2 and 3. An AC source 20 is used to heat the cathode electrode 1 and the thermionic electrons emitted by the cathode electrode 1 are uniformly dispersed or controlled by the grid electrode 2 to impinge upon the fluorescent film 4 thus causing the picture elements of the fluorescent film 4 to fluoresce. At this time, the electrons are injected into the switching element 3 having a V-I characteristic as shown in FIG. 3. Accordingly, when the voltage of the source 9 is varied, it is possible to hold the luminuous state of the picture element by the memory action thereof. More particularly, when the source voltage is increased according to the order of $O \rightarrow V_1 \rightarrow V_2$ as shown in FIG. 3, the switching element 3 is turned on at a voltage $V_2$. At the same time, the voltage across the switching element 3 decreases. Under these conditions, electrons are directed to the fluorescent film 4 of this switching element 3 causing the film 4 to luminesce. Thus, while the switching element 3 is maintained conductive, even when the voltage is decreased from $V_2$ to $V_1$, the conductive state is held. When the voltage is decreased below the voltage $V_1$ the switching element 3 is turned off, and the fluorescence of the fluorescent film 4 disappears. At this time, the voltage across the switching element 3 increases. Once the switching element 3 is turned off, the non-conductive state will be maintained even when the voltage is increased to a point near $V_1$. When the voltage is increased again to voltage $V_2$, the switching element 3 is turned on again.

It is advantageous to vary the voltage of the source 8 in a range of from 20 to 30 volts and to vary the voltage of the source 9 in a range of from 5 to 10 volts so as to maintain the current at about several ten milli-amperes, for the purpose of decreasing the power consumption of the display device.

A fluorescent display device can be prepared by arranging a plurality of fluorescence display elements shown in FIG. 2 in a matrix by well known integrated circuit technique. In this case, each switching element is provided with a pair of terminals, one connected to an X-axis lead wire (or the row wire) of the matrix and the other connected to a Y-axis lead wire (or the column wire). When a bias voltage of $V_1$ is applied to a selected X-axis lead wire and the sum of the bias voltage and a voltage supplied to a selected Y-axis lead wire exceeds the voltage $V_2$, the selected fluorescent display element fluoresces. Even when the voltage is impressed momentarily upon the Y-axis lead wire, the display element continues to fluoresce until the bias voltage on the X-axis lead wire is removed. In this manner, by controlling all switching elements it is possible to display any character, digit or pattern.

Although switching elements having a memory function are shown, it is also possible to use such active elements as contact elements not having a memory action.

Figure 4:
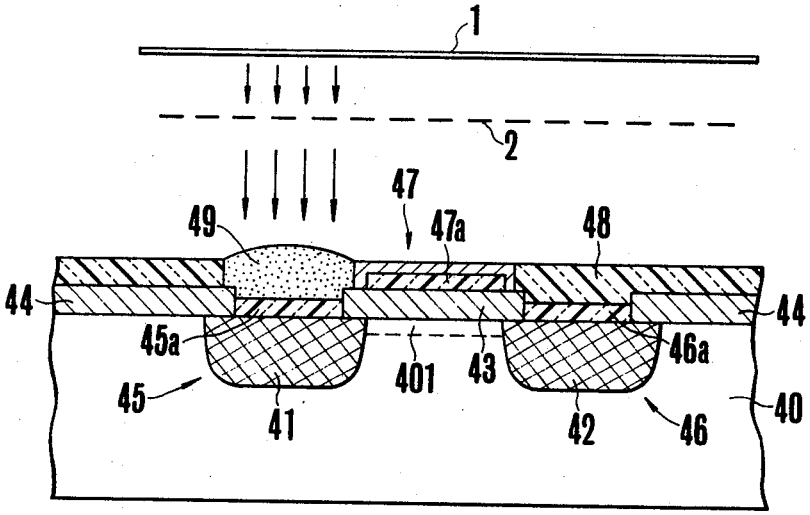
FIG. 4 is an enlarged sectional view showing a modified fluorescent display element of this invention.

An MOS fluorescent display element shown in FIG. 4 comprises a cathode electrode 1, a grid electrode 2, a P-type silicon substrate 40 generally made of a single crystalline substrate, $N^+$ regions 41 and 42 formed by diffusing an impurity into the P-type silicon substrate 40, silicon oxide films 43 and 44 covering the substrate and the $N^+$ regions, a source electrode **45*a* formed on the $N^+$ region 41, a drain electrode 46*a* formed on the $N^+$ region 42, a gate electrode 47*a* formed on the silicon oxide film 43, an insulating film 48 overlying the silicon oxide film 44, and a phosphor member 49 coated on the source electrode 45*a*. When the electrons from the cathode electrode 1 impinge upon the phosphor member 49, it fluoresces. A channel 401 is provided between the $N^+$ regions 41 and 42. Although not shown, it should be understood that a transparent face plate is sealed to the substrate 40 in the same manner as in the first embodiment shown in FIG. 1**.

Figure 5:
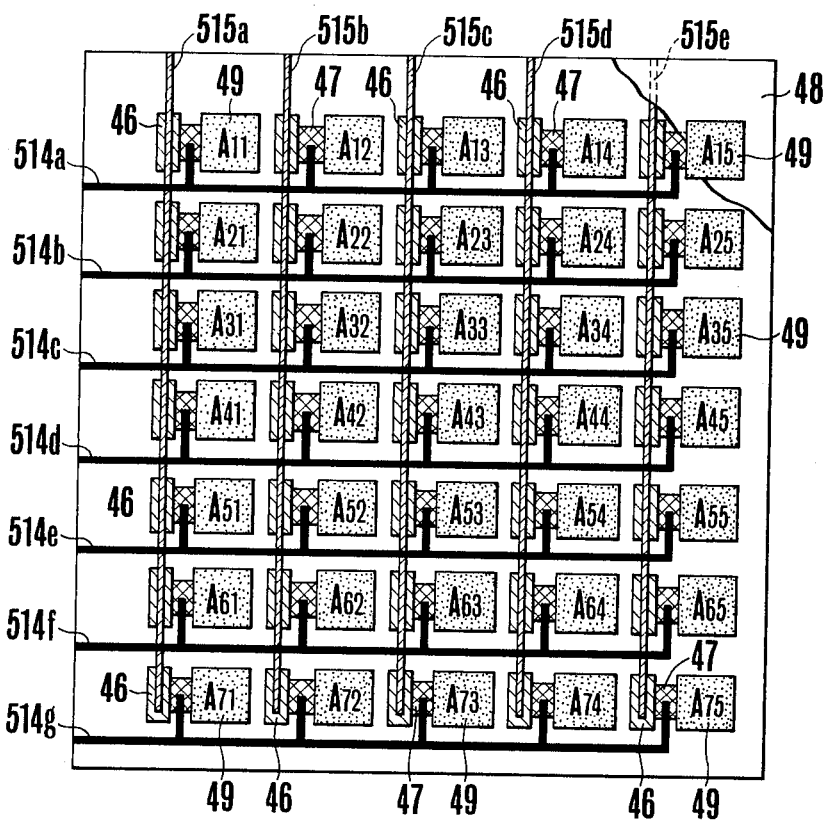
FIG. 5 is a plan view showing the anode structure of the fluorescent display device utilizing the fluorescent display elements shown in FIG. 4.
Figure 7:
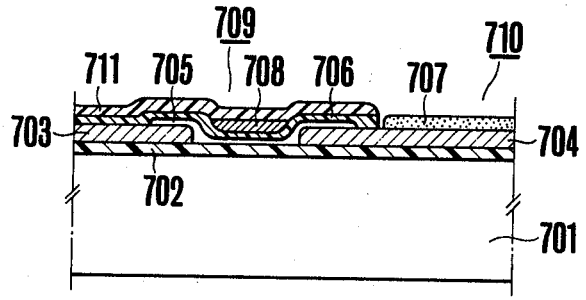
FIG. 7*a* is a sectional view showing another embodiment of the fluorescent display elements of this invention.
FIG. 7*b* is a connection diagram of one example of the fluorescent display device utilizing the fluorescent display elements shown in FIG. 7*a*.
Figure 7:
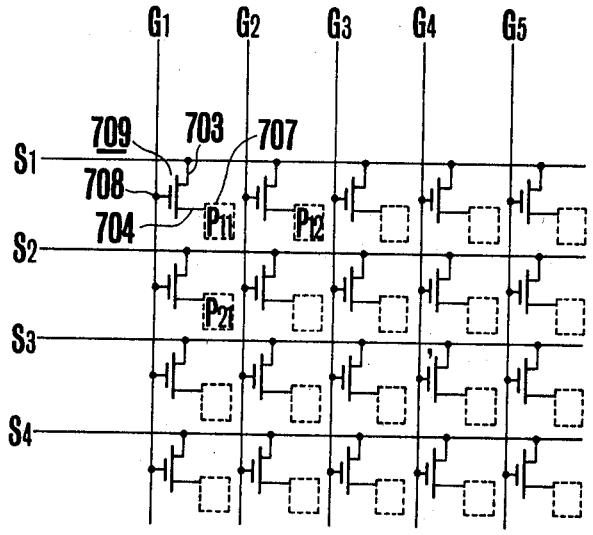

FIG. 5 is a plan view of a fluorescent display device in which a plurality of fluorescent display elements shown in FIG. 4 are arranged in a matrix comprising seven rows and five columns, for example. The matrix comprises X-axis lead wires **514*a* through 514*g* respectively connected to the gate electrodes 47 of the display elements $A_{11}$–$A_{15}$, $A_{21}$–$A_{25}$, . . . , $A_{71}$–$A_{75}$ each comprising the phosphor member 49 shown in FIG. 4, and Y-axis lead wires 515*a* through 515*e* respectively connected to the drain electrodes 46 of the display elements $A_{11}$–$A_{71}$, $A_{12}$–$A_{72}$, . . . , $A_{15}$–$A_{75}$. Respective display elements are spaced by an overcoat film 48** and assembled into an integrated circuit.

Figure 6:
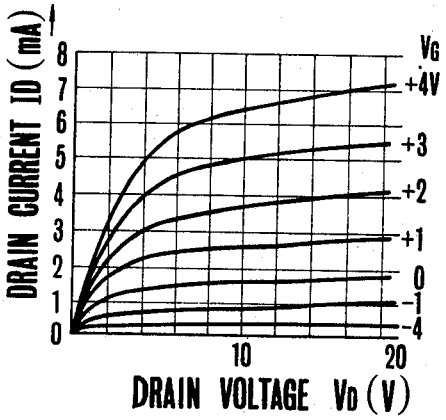
FIG. 6 is a graph showing the drain voltage-drain current characteristics of the fluorescent display element shown in FIG. 4.

The element shown in FIG. 4 takes the form of MOS construction, for example, so that it operates in the same manner as a conventional junction type field effect transistor and its characteristics may be shown by FIG. 6. Although the above-described embodiment was shown as an N channel field effect transistor, it will be clear that the element of this invention can also be formed as a P channel field effect transistor.

The fluorescent display device shown in FIG. 5 operates in the following manner.

When a predetermined voltage of about 20 volts is impressed across the cathode electrode 1 and the source electrode 45, the electrons emitted by the cathode electrode 1 are uniformly dispersed by the grid electrode 2 impressed with a voltage of about 20 volts and then travel toward respective phosphor members 49 of 35 display elements $A_{11}$ through $A_{75}$. Under these conditions, a positive voltage $V_G$ is impressed upon a selected X-axis lead wire, **514*a* for example, and a positive voltage $V_D$ is impressed upon a selected Y-axis lead wire, for example lead wire 515*a*. As a consequence, only the display element $A_{11}$ is selected. Under these conditions desired voltages are impressed upon the gate electrode 47 and the drain electrode 46, respectively. Consequently, the display element $A_{11}$ is turned on and the majority carriers, that is electrons, flow to the drain electrode 46 through channel 401. At this time the electrons emitted by the cathode electrode 1 are injected into the source electrode 45 through the grid electrode 2 and the phosphor member 49. Since the electrons are accelerated by the potentials impressed upon the grid electrode 2 and the drain electrode 46, they excite the phosphor member 49 causing it to fluoresce. Consequently, the fluorescent element $A_{11}$ is caused to fluoresce and its brightness can be controlled by the voltages impressed upon the gate electrode 47 and the drain electrode 46**.

Where it is desired to provide a dynamic action function for the display elements $A_{11}$ through $A_{75}$, the gate insulating film may be made of a SIPAS film (semi-insulating polycrystalline silicon). When silicon ribon crystal is used to prepare the P type silicon substrate, the cost can be decreased.

A thin film element of the fluorescent display element of this invention is shown in FIG. **7*a*, wherein a silicon nitride ($Si_3N_4$) film 702 is formed on the surface of a glass substrate 701 by vapor deposition or a CVD (chemical vapor deposition) technique. An aluminum layer is formed on the surface of the silicon nitride film 702 by vapor deposition for example, and the aluminum layer is then photoetched to form wiring layers and electrodes 703 and 704 between which a cadmium selenide layer is formed by vapor deposition or sputtering technique. The cadmium selenide layer is photoetched to form a semiconductor layer 705 having opposite ends connected to the electrodes 703 and 704. A silicon nitride film is then formed on the various layers described above by vapor deposition or a CVD technique and the silicon nitride film is photoetched to form an insulating film 706. The insulating film 706 does not completely cover the electrode and a phosphor layer 707 consisting of ZnO : Zn is applied to the exposed portion of the electrode 704** as by printing.

A gate electrode 708 is formed on the insulating layer 706 between electrodes 703 and 704. In this manner, a MIS (metal-insulator-semiconductor) type transistor 709 and its associated phosphor member 710 are formed on the glass substrate 701, and the electrodes 703 and 704 respectively operate as the source electrode and the drain electrode of the transistor associated with the phosphor layer 707. A passivation film 711 made of silicon nitride is applied to cover the surface except the region in which the phosphor layer 707 has been formed.

A plurality of unit fluorescent display elements described above are disposed on a glass substrate in the form of a matrix, as shown in FIG. *7b*.

More particularly, the gate electrodes of the MIS type transistors arranged on the same column are commonly connected to lead wires $G_1$, $G_2 \ldots G_5$ and the source electrodes of the respective MIS type transistors on the same row are commonly connected to the lead wires $S_1$, $S_2 \ldots S_4$. The lead wires extend to the outside of the glass substrate. The drain electrode 704 of each MIS type transistor is overlaid by a phosphor layer 707. Although not shown in the drawing, five wires acting as the cathode electrodes are formed above the array to extend over the several phosphor layers and a glass envelope is provided to cover the assembly.

When drive voltages are impressed upon selected one of the respective row and column lead wires, a selected phosphor member fluoresces to display a character or the like. For example, when a voltage is impressed upon lead wire $S_1$ making it positive with respect to the cathode electrode, and a gate signal pulse is applied on the lead wire $G_1$, a fluorescent display element with fluorescent member $P_{11}$ is turned on thus applying the voltage of lead wire $S_1$ on its drain electrode. As a consequence, the electrons emitted by the cathode electrode impinge upon the phosphor member $P_{11}$ causing it to luminesce.

With this construction, since the driving transistor is formed inside of the fluorescent display device, it is not necessary to provide the driving transistor on the outside of the display device as in the prior art device. Further, as it is not necessary to provide an electron gun, it is possible to substantially reduce the thickness of the display device. And since the cathode electrode is disposed close to the phosphor layer (a gap between the cathode electrode and the phosphor layer is about 2 mm), it is possible to drive the display device with a low voltage.

In the embodiment shown in FIGS. *7a* and *7b*, the MIS type transistors have no memory action, but the embodiment shown in FIGS. *8a* and *8b* utilizes MIS transistors having a memory action, in which elements corresponding to those shown in FIGS. *7a* and *7b* are designated by the same reference characters. In FIG. *8a*, between the semiconductor layer 705 and the gate electrode 708 are interposed an $SiO_2$insulating layer 800 and a floating gate layer 801 of aluminum or polycrystalline silicon, gate 801 being separated from gate 708 by layer 800.

With this construction, it is possible to provide a memory action to the display device. Accordingly, when pulses are sequentially applied to lead wires, it is possible to sequentially luminesce the phosphor members. Since the phosphor members have a memory action, it is possible to apply the driving pulses at a low speed.

Although in this embodiment the semiconductor layers 705 overlie portions of the electrodes 703 and 704, the electrodes 703 and 704 may alternatively be formed above the semiconductor layer 705.

It should be understood that the MIS type transistors 709 and the phosphor members 710 may be made of materials other than those pointed out above. For example, an oxide film may be substituted for the silicon nitride film 702 formed on the glass substrate, and the semiconductor layer 705 may be made of cadmium sulfide (CdS) instead of cadmium selenide. Similarly, the gate insulating layer 706 may be made of silicon oxide or aluminum oxide, and the floating gate layer 801 may be made of polycrystalline silicon.

Although in the embodiments shown in FIGS. *7a*, *7b* and FIGS. *8a*, *8b* thin film type MIS transistors 709 were formed on the glass substrate 701, it is also possible to form MOS type transistors on the glass substrate in the same manner as above described. In such case, the display elements would preferably comprise MOS transistors formed in a silicon substrate, phosphor members formed on the source electrodes of the transistors and a cathode electrode disposed above the phosphor members. In such embodiment, when a gate voltage is impressed upon the gate electrode of a selected transistor, it will be turned on to cause the phosphor member to luminesce.

As above described, the fluorescent display element of this invention does not require any external driving transistor, thus greatly simplifying the wiring. Moreover, it is possible to operate it with a low driving voltage. Further, as the fluorescent display device is constructed by arranging a plurality of display elements in a matrix, it is possible to simplify the circuit for controlling the brightness. Since the switching elements are formed as an integrated circuit by using silicon or the like, it is possible to decrease the cost of manufacturing. And since the display devices of this invention can display clear pictures, they are suitable for use in a wall hanging type television set, in a motor car interior indicator panel or as an output panel of a facsimile equipment.

Whereas the present invention has been described above by making reference to particular embodiments shown in the drawing, it is to be understood that such embodiments are intended to be illustrative rather than limiting, and it is contemplated that many alterations and modifications could be made without departing the merits of the invention. Accordingly, it is intended that the appended claims be interpreted as covering all such alterations and modifications as fall within the true spirit and scope of the invention.

What is claimed is:

1. A fluorescent display element comprising:

a substrate;

a transparent envelope hermetically sealed to said substrate and forming an evacuated sealed space therebetween;

a switching element formed on said substrate within said sealed space;

a fluorescent film formed on a part of said switching element;

a cathode electrode provided within said sealed space in spaced-apart facing relationship with said flourescent film; and a grid electrode interposed between and spaced apart from said cathode electrode and said fluorescent film.

2. A fluorescent display element as recited in claim 1 wherein said switching element has a memory function.

3. A fluorescent display element as recited in claim 1 wherein said switching element includes a field effect transistor having a source electrode and said fluorescent film is formed on said source electrode.

4. A fluorescent display element as recited in claim 1 wherein said switching element includes a MIS type transistor having a drain electrode and said fluorescent film is formed on said drain electrode.

5. A fluorescent display element as recited in claim 1 wherein said switching element includes a thin film transistor having a drain electrode and said fluorescent film is a phosphor member formed on said drain electrode.

6. A fluorescent display element as recited in claim 1 wherein said switching element includes a field effect transistor having a source electrode and a drain electrode, and said fluorescent film is formed on one of said electrodes.

7. A fluorescent display element as recited in claim 1 wherein said switching element includes a MIS type transistor having a source electrode and a drain electrode, and said fluorescent film is formed on one of said electrodes.

8. A fluorescent display element as recited in claim 4 wherein said switching element has a memory function.

9. A fluorescent display element as recited in claim 5 wherein said switching element has a memory function.

10. A fluorescent display device comprising:

a substrate;

a transparent envelope hermetically sealed to said substrate and forming an evacuated sealed space therebetween;

a plurality of switching elements arranged on said substrate in the form of a matrix, each said switching element including a fluorescent film applied to a part thereof, a first electrode connected to an X-axis lead wire, and a second electrode connected to a Y-axis lead wire of said matrix;

a plurality of cathode electrodes provided in said sealed space in spaced-apart facing relationship with said fluorescent films; and a control electrode disposed between and spaced apart from said cathode electrodes and said fluorescent films.

11. A fluorescent display device as recited in claim 10 which further comprises an overcoat for separating and assembling the plurality of switching elements into an integrated circuit.

12. A fluorescent display device as recited in claim 11 wherein each switching element includes a field effect transistor having a source electrode, drain electrode and a gate electrode, and wherein said fluorescent film includes a layer of phosphor formed on the source electrode, the gate electrode is connected to an X-axis lead wire, and the drain electrode is connected to a Y-axis lead wire of the matrix.

13. A fluorescent display device as recited in claim 11 wherein each switching element includes a MIS type transistor having a drain electrode, a source electrode and a gate electrode, and wherein a phosphor member is formed on the drain electrode, the source electrode is connected to an X-axis lead wire and the gate electrode is connected to a Y-axis lead wire.

14. A fluorescent display device as recited in claim 11 wherein each said switching element comprises a thin film transistor including a drain electrode, a source electrode and a gate electrode, and wherein a phosphor member is formed on the drain electrode, the source electrode is connected to an X-axis lead wire and the gate electrode is connected to a Y-axis lead wire of the matrix.

* * * * *